US005722035A

United States Patent [19]

Matysik et al.

[11] Patent Number: 5,722,035

[45] Date of Patent: Feb. 24, 1998

[54] METHOD OF PRODUCING HUNTING PROJECTILE WITH HOLLOW POINT

[75] Inventors: Peter Matysik, Deister; Heinz Wiechmann, Garbsen, both of Germany

[73] Assignee: Wilhelm Brenneke GmbH & Co. KG, Langenhagen, Germany

[21] Appl. No.: 489,891

[22] Filed: Jun. 13, 1995

[30] Foreign Application Priority Data

Jun. 13, 1994 [DE] Germany ..... P 44 20 505.8

[51] Int. Cl.[6] ..... B22F 1/00

[52] U.S. Cl. ..... 419/28; 419/29; 419/38; 29/1.2; 29/1.22; 29/1.23; 102/508

[58] Field of Search ..... 29/1.2, 1.22, 1.23; 419/38, 29, 28; 102/508

[56] References Cited

U.S. PATENT DOCUMENTS 2,411,379 11/1946 Langhammer . .

5,127,332 7/1992 Corzine et al. .

5,131,123 7/1992 Brooks .

5,399,187 3/1995 Mravic .

*Primary Examiner*—Charles T. Jordon

*Assistant Examiner*—Anthony R. Chi

*Attorney, Agent, or Firm*—Michael J. Striker

[57] ABSTRACT

A hunting projectile with a hollow point is produced with a only few working steps, and in particular a hollow point construction is formed out only in one working step. For this purpose the whole projectile is made of a metal powder by a powder-metallurgical process and then calibrated and during the powder pressing, the hollow tip construction is brought in so that during the calibration it is deformed to produce a final projectile tip.

7 Claims, 1 Drawing Sheet

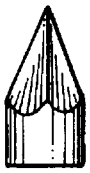
FIG. 1.1a
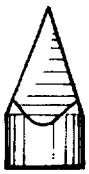
FIG. 1.2a
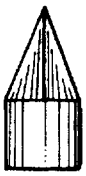
FIG. 2.1a
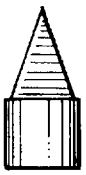
FIG. 2.2a
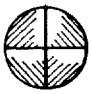
FIG. 1.1b
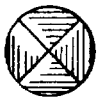
FIG. 1.2b
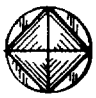
FIG. 2.1b
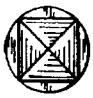
FIG. 2.2b
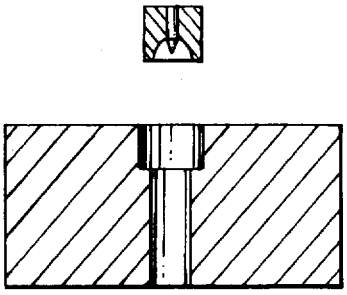
FIG. 3

METHOD OF PRODUCING HUNTING PROJECTILE WITH HOLLOW POINT

BACKGROUND OF THE INVENTION

The present invention relates to a method of producing hunting projectiles with hollow tips.

Projectiles which are suitable for hunting must possibly leave the body and at the same time give up a sufficient energy to the target so as to avoid jumping of an animal. The energy transfer in the target is possible in a projectile only over its cross-sectional surface or over its fragment. Projectiles which do not change their shape can demonstrate a greater surface in the shooting direction only by wobbling. Since this condition is not well controllable for different target resistances, hunting can be different.

With this in view, projectiles have been developed with a cross-section which is increased in the target by a so-called obturation or mushroom head formation. Partial jacketed bullets which belong this group have a jacket of a copper alloy or a copper-nickel plated low carbon or soft steel and a core of a lead alloy. For providing a reliable obturation also in the case of low target resistances and low impact velocities, this core must be formed of very soft lead. With this approach it is possible to obtain the desired function of providing a reliable obturation and not complete destruction of the projectile in the target, only in a small region of impact velocities and target resistances corresponding with one another. With higher target resistances and/or higher impact velocities, these projectiles often increase in their cross-section too much and as a result, especially in larger animals, do not achieve the desired penetration depth. Occasionally, these projectiles complete break into small fragments. For preventing this, some projectiles have a core composed of two parts. In particular a forward core of soft lead and a rearward core of hard lead. The soft, forward core is deformed in the target while the rear core penetrates deep into it, or in Other words deliver an exit would desired by a hunter. Such projectiles are complicated and expensive to manufacture. A further disadvantage of all lead core projectiles is a part of their mass remains finely distributed in the animal body. This can lead after corresponding treatment of the animal to undesired, toxic lead intake during consumption.

For avoiding these disadvantages, lead-free hunting projectiles have been developed. They have a massive body of copper or copper alloy. Since these materials are very hard in comparison to lead, it is necessary to provide a hollow point construction. As a result, such projectiles obtain a cross-sectional expansion by spreading of their tips.

U.S. Pat. No. 5,131,123 discloses a method of producing a hollow point projectile. In the beginning of the process pieces of a copper strand material are cut to length, annealed, and finally calibrated with respect to their length and diameter. These method steps are followed by the forming out of the hollow point in the projectile body. In several subsequent stations, a pressing plunger is utilized for pressing into one of the end sides of the projectile body. The hollow point is thereby formed out deeper and deeper until it obtains its final depth and configuration. Then further method steps follow, in which the projectile obtains its final shape. The disadvantage of this project is that a plurality of working steps is required for production of this projectile. In particular, the forming out of the hollow tip is very expensive.

Furthermore, jacketed bullets are known in the military field, which are composed of a sintered core of tungsten. Here sintering process is utilized in order to provide simple working of the very hard and brittle tungsten material. The final tungsten core has a very high hardness and very specific weight with relatively small diameter. This results in a very high sectional density and thereby a good armor plate penetration. Such projectiles are not suitable for hunting.

SUMMARY OF THE INVENTION

Accordingly, it is an object of the present invention to provide a method of producing hunting projectiles with hollow tips, which avoids the disadvantages of the prior art.

More particularly, it is an object of the present invention to provide a method of producing a projectile of this type with a hollow point, which requires only a few working steps and in which in particular the hollow point construction can be formed out only in one working step.

In keeping with these objects and with others which will become apparent hereinafter, one feature of the present invention resides, briefly stated, in a method of producing a hunting projectile, in accordance with which the whole projectile is produced by a powder metallurgical process from a metal powder and then calibrated, and during the powder pressing the hollow point construction is brought in, which during the calibration is deformed to the final projectile tip.

With this method in order to obtain the final projectile substantially only three working steps are needed, namely the pressing, sintering and calibration. In the methods in accordance with the prior art, the expensive forming out of the hollow point construction is performed during the required pressing, so that for this purpose no special working step is needed.

In accordance with a further embodiment of the invention, a heavy element, for example tungsten is introduced into the matrix of metal powder, for which purpose preferably copper powder is utilized.

The projectiles known from the prior art and composed of copper or a copper alloy have the disadvantage of a low sectional density since these materials, in contrast to a total density of approximately 10 g/cm$^3$ of the metallic cartridge have only a density of substantially 8.8 g/cm$^3$. For this purpose these projectiles, when it is necessary to maintain their weight, must be formed longer. As a result there is a worsening of the outer and target-ballistic condition since the spin stabilization is optimal only in a narrow region of the projectile length and rotation speed.

The method of the present invention provides advantages since for increase of the total density heavy elements such as for example tungsten can be embedded into the copper matrix even if they are not subjected to alloying with the basic material. In this way the total projectile densities can be obtained, which substantially correspond to conventional jacketed bullets.

The inventive method also provide advantages with respect to the density and thereby strength characteristics in the projectile which are adjusted in a single-axis press in the projectile body. It has been shown that thereby a relatively hard projectile base can be obtained, which as in the prior art acts positively on the penetration depth and the exit of the projectile.

A further advantage of the inventive method is obtained when the inner wall of the press die is provided before the pressing process with a sliding auxiliary means, in particular graphite or boron nitride, such as by spraying. Regardless of the fact that the powder thereby better slides during depressing on the die wall, graphite or boron nitride particles also deposit on the upper surface of the projectile or the region close to the upper surface. Thereby during use the friction between the barrel and the projectile is reduced.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 1.1*a* and 1.1*b* are views showing a pyramid-shaped plunger for bringing in a hollow tip construction during pressing a projectile body, on a side view and on a plan view;

FIGS. 1.2*a* and 1.2*b* are views substantially corresponding to the views of FIGS. 1.1*a* and 1.1*b*, but showing the pyramid-shaped plunger turned by 90°;

FIGS. 2.1*a* and 2.1*b* are views showing another embodiment of a pyramid-shaped plunger in accordance with the present invention, also on a side view and on a plan view;

FIGS. 2.2*a* and 2.2*b* are views showing the same pyramid-shaped plunger in accordance with the second embodiment, but turned by 90°; and FIG. 3 is a view showing a section through a plunger for calibration of a projectile tip, as well as an associated calibration die.

DESCRIPTION OF THE PREFERRED EMBODIMENTS

In accordance with a method for producing a hunting projectile with a hollow point a basis material for the projectile to be produced is selected to be a heavy electrolytic copper powder with a maximum grain size of 200 μm and a dendrite grain shape. Because of the above identified grain size and grain shape, this powder provides for high green strength and green density. 15% of tungsten metal powder HC 1,000 is mixed with the above identified copper powder. The thusly made mixture is then supplied in a dosed manner into a pressing tool which is closed from above with a pyramid-shaped plunger shown in FIGS. 1.1*a*–2.2*b*. The pressing pressure is applied from below by a cylindrical lower plunger. It amounts to approximately 560 MPa. After finishing the compression, the pyramid-shaped upper plunger is lifted in the green article, is expelled by the lower plunger upwardly. After withdrawal of the green article by a handling system, the lower plunger is moved again to the zero position for preparation of the next pressing step.

The forming out of the hollow point construction is performed during the pressing step by the pyramid-shaped upper plunger. The pyramid-shaped upper plunger with a step shown in FIGS. 2.1*a*–2.2*b* has the advantage that the green article in the upper region is not so thin-walled and thereby is substantially stable. It is generally recommended to add approximately up to 1 weight percent of pressing auxiliary agent to the powder mixture to increase the strength of the thin-walled edges in the region of the pressed-in pyramid.

After the pressing, the green article is sintered in charges in a inert gas furnace with hydrogen atmosphere during approximately 2 hours. The sintering temperature amounts to approximately 1,000° C.

Since the projectile body after the sintering process somewhat varies in diameter over its length, it must be calibrated at the end after the sintering. The sintered article is transferred for this purpose to a pressing tool which is schematically shown in FIG. 3. The loading is performed from above. The pressing tool is closed with an upper plunger which has the negative contours of the projectile tip. The deforming or calibrating pressure of approximately 820 MPa is applied by the not shown lower plunger. During the calibration process the projectile tip obtains by the upper plunger its final shape, and the pyramid-shape cavity provided before during pressing in the projectile body is squeezed together. As can be Seen from FIG. 3, the upper plunger is provided with a centrally arranged steel pin. During the calibration the material of the projectile tip is pressed around the steel pin. In this manner the projectile obtains a forwardly open hollow tip. After the calibration the finished projectile is expelled from the pressing tool.

In order to improve the target ballistic condition, the projectile after calibration can be annealed. Thereby a projectile remaining body of a greater diameter is obtained in the target.

It will be understood that each of the elements described above, or two or more together, may also find a useful application in other types of methods differing from the types described above.

While the invention has been illustrated and described as embodied in a method of producing a hunting projectile with a hollow tip, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of producing a hunting projectile with a hollow point, comprising the steps of making a whole projectile in a powder-metallurgical process of a metal powder including powder pressing; subsequently calibrating the projectile; bringing-in a hollow point construction during the powder pressing; and deforming the hollow point construction during the calibrating to provide a final projectile tip.

2. A method as defined in claim 1; and further comprising the step of admixing a heavy element to the metal powder in order to increase a total density of the projectile.

3. A method as defined in claim 2, wherein the metal powder is a copper powder.

4. A method as defined in claim 3, wherein the heavy element is tungsten.

5. A method as defined in claim 1; and further comprising the step of providing an inner wall of a pressing die which is utilized for pressing the powder, with a sliding assisting agent, before the pressing.

6. A method as defined in claim 5, wherein the sliding assisting agent is graphite.

7. A method as defined in claim 5, wherein the sliding assisting agent is boron nitride.

* * * * *